US007341658B2

(12) United States Patent
Reeves

(10) Patent No.: US 7,341,658 B2
(45) Date of Patent: Mar. 11, 2008

(54) RECOVERY OF HEAVY MINERALS FROM A TAR SAND

(75) Inventor: Robert G. Reeves, Spring, TX (US)

(73) Assignee: Tatanium Corporation Inc., Toronto (CA)

( * ) Notice: Subject to any disclaimer, the term of this patent is extended or adjusted under 35 U.S.C. 154(b) by 504 days.

(21) Appl. No.: 10/417,271

(22) Filed: Apr. 17, 2003

(65) Prior Publication Data

US 2004/0035755 A1 Feb. 26, 2004

Related U.S. Application Data

(60) Provisional application No. 60/373,323, filed on Apr. 18, 2002.

(51) Int. Cl.
*C10G 1/04* (2006.01)

(52) U.S. Cl. ..... 208/390; 208/252; 75/365; 75/430; 75/435; 75/958; 204/61; 204/64; 204/64 T; 204/67; 205/560; 423/522; 423/541; 423/541 R; 423/567 R

(58) Field of Classification Search ..... 75/365, 75/430, 435, 958; 204/61, 64, 64 T, 67; 205/560; 208/252, 390; 423/522, 541, 541 R, 423/567 R
See application file for complete search history.

(56) References Cited

U.S. PATENT DOCUMENTS 3,990,885 A 11/1976 Baillie et al. ..... 423/70
4,111,789 A 9/1978 Porteous et al. ..... 208/11 LE
4,138,467 A 2/1979 Kaminsky et al. ..... 423/74
4,150,093 A 4/1979 Kaminsky et al. ..... 423/74
4,225,422 A 9/1980 Trevoy et al. ..... 209/2
4,240,897 A 12/1980 Clarke ..... 208/11 LE
4,274,948 A 6/1981 Robinson ..... 209/9
4,818,373 A * 4/1989 Bartholic et al. ..... 208/252
5,124,008 A * 6/1992 Rendall et al. ..... 205/560
6,214,213 B1 4/2001 Tipman et al. ..... 208/390

FOREIGN PATENT DOCUMENTS

CA 1180827 1/1985
CA 1241297 8/1988
CA 1326571 1/1994
CA 2044731 8/1997

* cited by examiner

*Primary Examiner*—Glenn Caldarola
*Assistant Examiner*—Prem C. Singh
(74) *Attorney, Agent, or Firm*—Bennett Jones LLP

(57) ABSTRACT

A process for recovering heavy minerals (e.g., titanium minerals such as $TiO_2$) from a feedstock comprising tar sands or a tar sands-derived solids fraction. The feedstock comprises bitumen and heavy minerals. The process comprises the steps of: (i) contacting the solids fraction with water at a temperature of at least about 100° F. to cause production a bituminous phase and a heavy minerals phase; and (ii) separating the heavy minerals phase from the bituminous phase. Optionally, these steps may be preceded by one or more steps used to produce a tar-sands derived solids fraction from a tar sands feedstock.

24 Claims, 1 Drawing Sheet

RECOVERY OF HEAVY MINERALS FROM A TAR SAND

CROSS-REFERENCE TO RELATED APPLICATION

The present application claims the benefit under 35 U.S.C. §119(e) of provisional patent application Ser. No. 60/373,323, filed Apr. 18, 2002, the contents of which are hereby incorporated by reference.

BACKGROUND OF THE INVENTION

1. Field of the Invention

In one of its aspects, the invention relates to a process for the recovery of heavy minerals from tar sands or a feedstock derived from tar sands. More particularly, the invention relates to a process for the separation of bitumen from the heavy minerals component of the tar sands or a feedstock derived from tar sands.

2. Description of the Prior Art

Extensive deposits of tar sands, bituminous sands, bituminous diatomite and similar materials are known to exist throughout the world. These materials comprise a siliceous matrix of sands, sandstones or diatomaceous earth, which is coated or saturated with relatively high molecular weight hydrocarbon materials. These deposits are generally located at or near the Earth's surface, although some deposits may be buried by as much as two thousand feet of overburden. It has been estimated that the reserves of petroleum products recoverable from the known deposits of tar sands would be approximately equivalent to the worldwide reserves estimated for conventional crude oil.

As mined, the tar sands are present in general as agglomerates or lumps comprising sand, clay, water and viscous hydrocarbonaceous material called bitumen.

The predominating mineral component of the material as mined is, in most cases, as quartz sand. Typically, the quartz sand is surrounded by bitumen in quantities of in the range of from about 5 to about 20 or more weight percent of the total composition. In addition, tar sands generally also contain colloidal (~2 μm diameter) material, usually referred to as colloidal clay since it contains silica and alumina, in quantities of from about 1 to about 50 weight percent of the total composition.

It is known that the bitumen may be upgraded to a hydrocarbon material of lower molecular weight, in particular to a hydrocarbon material that is liquid at room temperature.

Several methods have been developed for purifying tar sands to provide bitumen concentrates that can be used as feedstock for further upgrading to produce useful products. The principal purification technique which has been applied to tar sands in order to concentrate bitumen therefrom is extraction. One type of extraction conventionally used is known as the "hot water" process. In the "hot water" process, advantage is taken of the fact that tar sands produce bituminous slurry when mulled with hot water and sodium hydroxide. The bituminous slurry is recovered, treated with a hydrocarbon diluent, and then subjected to a centrifugation process that yields a tailings comprising heavy minerals to which some of the bitumen remains adhered.

It is known to further treat the tailings to separate the bitumen from the heavy minerals to improve the purity of heavy minerals. Specifically, it is conventional to subject the tailings to high temperature roasting to "bum off" the bitumen from the heavy minerals. Unfortunately, the high temperature roasting is cost intensive and effects removal of the bitumen at the expense of erasing the magnetic contrast between the remaining heavy minerals. The lack of magnetic contrast hinders separation of valuable minerals, such as titanium (e.g., $TiO_2$), from gangue materials.

Notwithstanding the advances made in the art to date, there is still room for improvement. For example, there is still a need in the art for an efficient process for recovery of valuable minerals (such as minerals of titanium) from a tar sands starting material or a feedstock derived from tar sands. It would be advantageous if such a process were relatively low cost to implement and practice.

SUMMARY OF THE INVENTION

It is an object of the present invention to obviate or mitigate at least one of the above-mentioned disadvantages of the prior art.

Accordingly, in one of its aspects, the present invention provides a process for recovering heavy minerals from tar sands, the tar sands including bitumen and heavy minerals, the process comprising the steps of:

(i) contacting the tar sands with an aqueous liquid at a temperature of at least about 100° F. to form a bituminous froth comprising a solids fraction and a liquid fraction, the solids fraction comprising bitumen and heavy minerals;

(ii) adding a hydrocarbon diluent to the bituminous froth to produce a diluted bituminous froth;

(iii) separating the solids fraction from the diluted bituminous froth to produce a treated solids fraction;

(iv) contacting the treated solids fraction with an aqueous liquid to cause production a bituminous phase and a heavy minerals phase; and (v) separating the heavy minerals phase from the bituminous minerals phase.

In another of its aspects, the present invention provides a process for recovering heavy minerals from feedstock comprising tar sands, the tar sands including bitumen and heavy minerals, the process comprising the steps of:

(i) contacting the feedstock with water at a temperature of at least about 100° F. to form a bituminous froth comprising a solids fraction and a liquid fraction, the solids fraction comprising bitumen and heavy minerals;

(ii) separating the solids fraction from the liquid fraction;

(iii) contacting the treated solids fraction with water at a temperature of at least about 100° F. to cause production a bituminous phase and a heavy minerals phase; and (iv) separating the heavy minerals phase from the bituminous phase.

In another of its aspects, the present invention provides a process for recovering heavy minerals from tar sands-derived solids fraction comprising bitumen and heavy minerals, the process comprising the steps of:

(i) contacting the solids fraction with water at a temperature of at least about 100° F. to cause production a bituminous phase and a heavy minerals phase; and (ii) separating the heavy minerals phase from the bituminous phase.

BRIEF DESCRIPTION OF THE DRAWINGS

Embodiments of the present invention will be described with reference to the accompanying drawing in which there is illustrated a flowsheet depicting a particularly preferred embodiment of the present process.

DETAILED DESCRIPTION OF THE PREFERRED EMBODIMENTS

Figure 1:
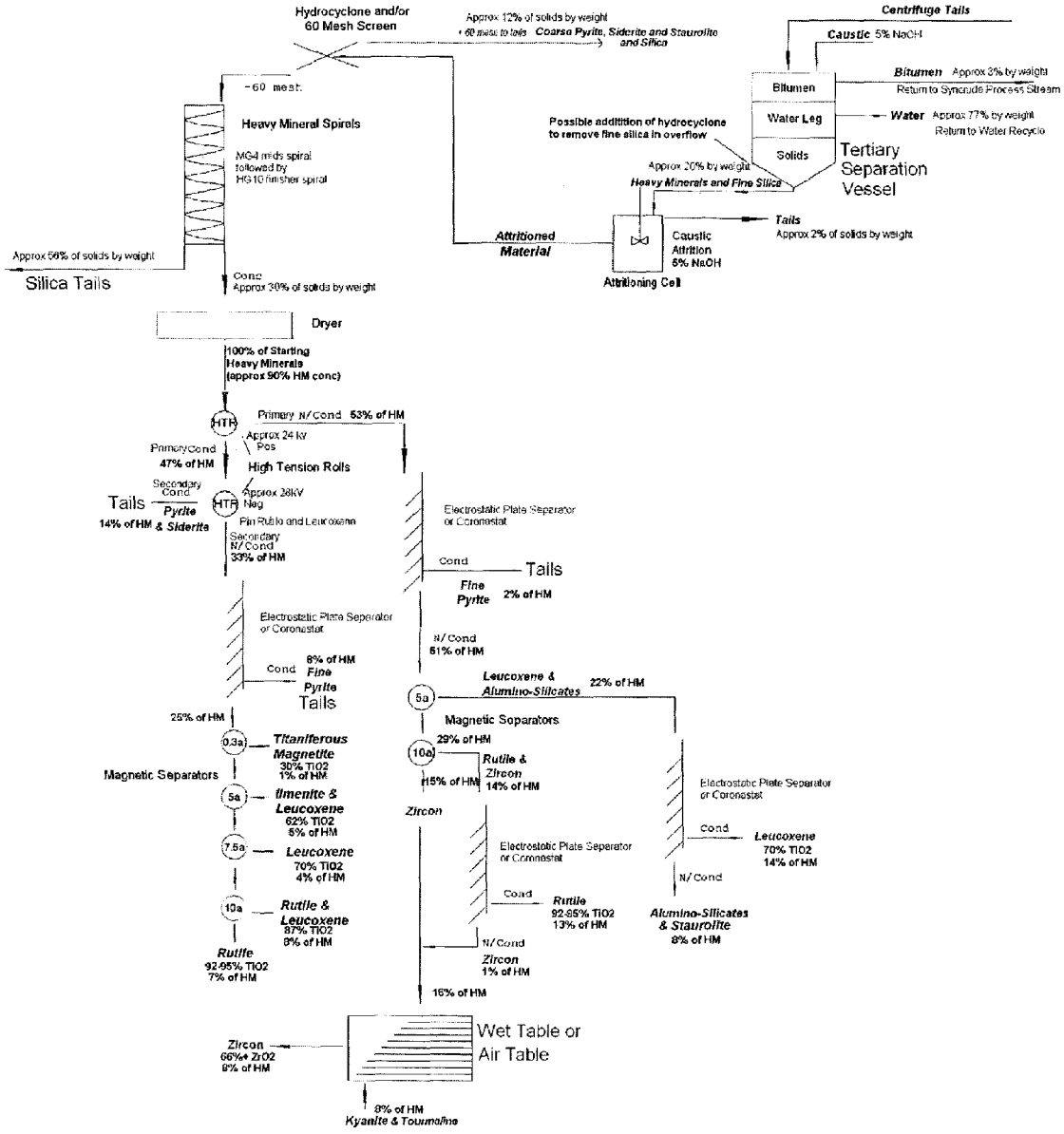

Generally the present invention relates to process recovery of heavy minerals from a tar sand starting material. During the process, a solids fraction is produced comprising the heavy minerals of interest, bitumen and, optionally, a hydrocarbon diluent.

While there is no universally accepted definition of "bitumen", it may be characterized as that portion of petroleum that exists in the semi-solid or solid phase in natural deposits. It has been proposed by the United Nations Institute for Training and Research (UNITAR) that bitumen, or natural tars, be defined as the petroleum component which has a viscosity greater than 10,000 mPa·s (cp) measured at the conditions in the deposit and gravity greater than 1,000 $kg/m^3$ (less than 10° API) at standard conditions of 15.6° C. (60° F.) and a pressure of one atmosphere. The definition was suggested at the Second International Conference on Heavy Crude and Tar Sands, held in Caracas, Venezuela on Feb. 7-17, 1982. At that time, it was also noted that a continuously variable spectrum of properties can be found, not only geographically between deposits, but also laterally and vertically within a given petroleum occurrence. Accordingly, the proposed definition employs essentially an arbitrary demarcation between bitumen and heavy crudes, when the materials are compared on the basis of these physical properties alone.

In addition to the above definition, bitumen is generally recognized as being a pre-cursor of petroleum. Bitumen has not been subjected to sufficient heat or pressure from depth of burial in the geologic system to "cook" the organic rich shales that constitute the source rocks for petroleum, to the extent required to break the long chain hydrocarbons of bitumen into the lighter fractions contained in crude oils.

Additional distinctions between bitumen and conventional heavy crude oil may be made on the basis of their chemical compositions. Relative to most heavy crudes, bitumen has a large asphaltene component. Asphaltenes are complex, polynuclear hydrocarbons that are insoluble in n-pentane and/or n-heptane. Due to their substantial asphaltene content, bitumens exhibit a high carbon/hydrogen ratio. For the preparation of transportation fuels, it is generally necessary to reduce the carbon/hydrogen ratio by the addition of hydrogen through catalytic hydrogenation (Shell's process), or through removal of carbon through coking (Syncrude and Suncor's process). Bitumen typically also contains significant amounts of sulphur, nitrogen and metals as contaminants, often substantially more than most conventional heavy crudes.

In a preferred embodiment of the present process, an initial step involves subjecting the tar sands by hot water extraction. For example, this can be accomplished by mixing the tar sands with hot water or hot aqueous liquid (e.g., a liquid comprising substantial amounts of water) in a tumbler. Preferably, the water or aqueous liquid is used at a temperature of at least about 100° F., more preferably in the range of from about 100° F. to about 200° F., even more preferably in the range of from about 110° F. to about 180° F., most preferably from about 120° to about 150° F.

The resultant slurry may then be introduced into a primary flotation vessel to generate a first bituminous froth and a solids tailings. Optionally, a middlings stream may be withdrawn from the primary flotation vessel proximate its midpoint. The middlings stream may be introduced to an aerated secondary flotation vessel to generate a second bituminous froth, which is then recovered and permitted to settle to reduce its water and solids content. Preferably, the first bituminous froth and the second bituminous froth are then combined and deaerated. The combined bituminous froth contains a mixture of bitumen and the desired heavy minerals fraction. The solids tailing produced in the primary flotation vessel typically comprises coarse silica sand and is generally devoid of heavy minerals.

Preferably, the combined bituminous froth is then subjected to further processing for separation of an enriched heavy minerals fraction substantially free of bitumen.

Thus, as an initial step in the further processing, the bituminous froth may be diluted with a suitable hydrocarbon diluent, such as naphtha, and the diluted stream may then be subjected to a two-stage centrifugation to recovering a solids fraction. In the first stage, the froth is treated in a scroll-type centrifugal separator to separate the coarse and/or denser solids, or a solids fraction, from a bituminous scroll product. The solids fraction is enriched in the heavy minerals. In the second stage, the bituminous scroll product is passed through a disc-type centrifugal separator to separate the fine solids and water from the bitumen. The solids fraction appears as tailings from the first stage, and includes a heavy minerals fraction to which some bitumen remains adhered.

An example of a typical heavy mineral fraction of the solids fraction is described in "Heavy Mineral Potential of Athabasca Oil Sands" by John Oxenford and Julian Coward, as presented in "$TiO_2$97 A View to 2000" held in Vancouver, British Columbia, Canada on Apr. 28-30, 1997, and is set out in Table 1. Of course, it will be appreciated that the precise make-up of a heavy mineral fraction can vary from that shown in Table 1 based on factors such as the point in time at which the sample is taken, the location from which the sample is taken and the like. Thus, the heavy mineral fraction is out in Table 1 is illustrative only.

TABLE 1

| Mineral | Weight % |
|---|---|
| Rutile | 26.8 |
| Ilmenite | 16.3 |
| Siderite | 15.5 |
| Anatase | 9.8 |
| Pyrite | 9.0 |
| Zircon | 7.7 |
| Tourmaline | 5.2 |
| Garnet | 2.6 |
| Magnetite | 1.9 |
| Monazite | 1.4 |
| Kyanite | 1.1 |
| Staurolite | 1.0 |
| Mica | 0.9 |
| Chlorite | 0.8 |

In addition to the heavy minerals, approximately 70% by weight of solids contained in the remaining bitumen in the centrifuge underflow is comprised of fine silica and colloidal clays. As stated above, the precise make-up of a heavy mineral fraction can vary based on factors such as the point in time at which the sample is taken, the location from which the sample is taken and the like. Thus, the can be some variation (e.g., 20-45 percent by weight heavy minerals) to the weight of solids contained in the remaining bitumen in the centrifuge underflow.

Those of skill in the art will recognize that the froth can be treated to separate a solids fraction enriched in the heavy minerals from an enriched bituminous phase using a system other than dilution centrifugation described above. For example, the froth may be treated by counter-current decantation. As another example, the froth can be treated by way of inclined plates.

If the solids fraction is processed by adding thereto a hydrocarbon diluent in a separation circuit as described above, it is preferred to remove substantially all of the hydrocarbon diluent from the recovered solids fraction prior to further processing of latter. If the further processing comprises gravity separation, and such gravity separation is configured to exact a purified heavy minerals section, the presence of undesirably high amounts of hydrocarbon diluent may compromise heavy minerals recovery.

Hydrocarbon diluent removal may be accomplished through a naphtha recovery unit contained in the separation plant system. Preferably such a naphtha recovery united may be operated to fractionally distil and re-condense naphtha for recovery and reuse in the system. Further, removal of the naphtha diluent is advantageous for facilitating recovery of a desired purity of heavy minerals, as presence of excessive diluent in the solids fraction compromises such recovery.

After removal of the hydrocarbon diluent, it is to contact the recovered solids fraction (at this point, the treated solids fraction comprise an enriched heavy minerals fraction to which some bitumen remains adhered) with water or aqueous liquid over a period of time sufficient to effect gravity separation of a bituminous phase from a heavy minerals phase—i.e., the latter while be extracted in the water or aqueous liquid phase. The solids fraction includes substantially no diluent, or at least a concentration of diluent no more than an amount effective to compromise the gravity separation by creating an unbreakable emulsion. In this respect, the solids fraction may comprise hydrocarbon diluent in an amount up to about 2 weight percent. It is believed that, where present, the hydrocarbon diluent is mixed with the bitumen forming part of the solids fraction.

Thus, the treated solids fraction is introduced into a gravity separation vessel and contacted with the water or aqueous liquid within the vessel for a sufficient period of time to effect the above-described gravity separation. Most, if not all, of the heavy minerals in the solids fraction will settle to the bottom of the vessel or "settling zone" as part of the heavy minerals phase. Most, if not all, of the bitumen will be separated from the heavy mineral phase and form part of the bituminous phase formed in an upper region of the vessel.

Preferably, the water or aqueous liquid used in this stage of the present process comprises a temperature of at least about 100° F., more preferably in the range of from about 100° F. to about 200° F., even more preferably in the range of from about 110° F. to about 180° F., most preferably from about 120° to about 150° F. In most applications, a temperature below about 100° F. is not sufficiently hot to reduce the viscosity of the bitumen and enable its separation from the heavy minerals phase. Further, in most applications, a temperature above about 200° F. causes the viscosity of the bitumen to become higher than desirable, and the bitumen tends to adhere to everything it comes into contact with, including the vessel. This can complicate heavy minerals recovery.

With reference to FIG. 1, there is illustrated a flowsheet a particularly preferred embodiment of the present process. The flowsheet shown in FIG. 1 sets out specific material balance fractions. As will be apparent to those of skill in the art, these fractions are illustrative only and likely would change with changes to the composition of the feedstock material and/or to various operating conditions. Further, equipment specifications may be adjusted as the process is scaled up to specific commercial operations.

In the flowsheet shown in FIG. 1, after gravity separation of the heavy minerals phase from the bituminous phase, the recovered bitumen may be returned to the centrifuge overflow bitumen product stream or sent for further processing to achieve required bitumen grade, as required. The recovered heavy minerals phase is subject to attritioning, such as by a Denver Cell™ attritioner in a dilute caustic solution, to yield clean heavy mineral grains surfaces sufficient to achieve desired high tension, electrostatic separations, which relies on differences in surface electrical potential of mineral components. Grain surfaces, which are covered by bitumen or other surface charge altering materials, can render high tension and electrostatic separation ineffective.

After attritioning, the heavy minerals may be subject to further separation into individual fractions by other gravity separation techniques in a wet milling circuit, using spirals or tables and particle sizers or the like. The heavy minerals may then be dried in a suitable device (e.g., a rotary dryer, a fluidized bed dryer or other suitable device) to remove water prior to subsequent dry milling steps, where the heavy mineral grain components are subjected to primary and secondary high-tension separation.

Primary high-tension separation removes conductive minerals, such as the titanium minerals and other iron bearing minerals, from non-conductive minerals such as zircon, garnet, tourmaline and other alumino-silicates.

Secondary high-tension separation of conductive minerals separates valuable titanium minerals, which are less conductive, from gangue iron bearing minerals, which are more conductive. The titanium minerals, being less conductive, remain pinned to a high tension roll, while the more conductive iron bearing gangue minerals are spun from the roll into a separate stream, as their electrical charge is lost. This has proven to be very effective with a near perfect separation of these materials in only a few passes over a high-tension roll. This replaces the ineffective and very expensive oxidizing roast described previously. It also eliminates the unwanted generation of $SO_2$ in roasting of pyrite, which is an extreme environmental problem.

The titanium mineral stream may then be cleaned of any remaining small amounts of gangue minerals on electrostatic plates or equivalent electrostatic equipment. Magnetic separation is then conducted to separate different grades of titanium minerals, as required by market conditions. If no magnetic separation is conducted, the average titanium grade is approximately 78% $TiO_2$, which is readily saleable, but can be further separated as needed for specific users. A magnetic separation of approximate 7000-8000 gauss will yield an approximate 85% $TiO_2$ or greater rutile and leucoxene product, which is approximately 75% by weight of the titanium minerals. This is equivalent to commonly used titanium slag products, which are produced through expensive smelting and slagging of lower grade ilmenite ores. Increasing or decreasing the intensity of magnetic separation, as required for specific purchasers, can produce other $TiO_2$ fractions. It is observed through magnetic fractionation of these products that there is a direct relationship between magnetic field intensity in separation and $TiO_2$ content, due to the fact that rutile (95% $TiO_2$) is less magnetic than leucoxene (60-85% $TiO_2$)

Non-conductive minerals recovered after primary high-tension separations are further separated on electrostatic plates or equivalent to recover very non-conductive zircon from garnets and other alumino-silicates. Additional magnetic separation is also conducted to remove any remaining small amounts of slightly magnetic materials from zircon and garnet products. A premium ceramic grade zircon product has been produced, along with a garnet product for abrasives markets.

EXAMPLE

This Example provides a description of a preferred embodiment of the present process and should not be used to construe or limit the scope of the invention.

Bitumen Separation/Sand

Bitumen/Water/Solids tails are obtained from centrifuge operations. The tails contain 4.0% bitumen by weight, 16-20% solids by weight, and 76-80% water by weight. The water phase average has an average pH in the range of 8-10. Liquid/Gas Chromatograph analysis shows the bitumen fraction contains $C_6$ through $C_{35}$ hydrocarbons, with majority of the in the $C_{14}$-$C_{28}$ range (fuel oil and lube oil range of refined products).

Separation of the components in mixture is accomplished by gravity separation of the different phases in a vertical column. Caustic (NaOH) is added to the water phase to maintain a pH of 10-11. The bitumen phase floats on top of the water phase, and is decanted off. The decanted bitumen phase may be returned to the bitumen process stream, where it may require further treatment to remove suspended clay before it can be sent through petroleum refining processes. The solids phase settles to the bottom of the column and is removed through a bottom valve as it builds up. At this point, the middle water phase level is maintained to provide the phase separation buffer between the bitumen phase and the water phase (containing the heavy metal solids). Excess water is returned to the tailings pond for re-use in process operations.

The solids underflow from previous step is subjected to further treatment, as the underflow still contains 0.872% (8720 ppm Total Petroleum Hydrocarbons [TPH by TNRCC 1005 analysis]) adhered bitumen by weight. This is further reduced through mechanical grain to grain scrubbing in a Denver cell attrittioner or equivalent, in additional caustic (NaOH) solution, with approximately 50% solids by weight, and an approximate 20 minute residence time. The liquid and suspended fines phase is decanted and the remaining sand sized solids are then rinsed in fresh water to remove remaining slimes. At this point, bitumen is reduced to approximately 0.424% (4240 ppm TPH) by weight, and adhered grains of fine silica and other unwanted material are removed from the desired heavy mineral grains.

Next, the solids undertow is subjected to a drying operation during which the material heated to 392° F. (200° C.) to remove the residual water fraction and thermally flash off up to approximately $C_{25}$ of the hydrocarbon fraction. This leaves primarily the heavy range of $C_{25}$-$C_{35}$ of the hydrocarbon fraction, measuring 0.0497% (497 ppm TPH). The temperature used during the drying operation is well below the thermal decomposition range of pyrite ($FeS_2$) (decomposition does not start until a temperature of 600° C. is reached) which would release unwanted $SO_2$ gases. The temperature used during the drying operation is also well below the temperature of alteration of magnetic susceptibility of the titanium and iron bearing minerals contained in the heavy minerals fraction (decomposition does not start until a temperature of 500° C. is reached). As discussed above, this unwanted effect occurs during the prior art approach wherein all of the bitumen is first removed by calcining at high temperature, rendering further magnetic and electrostatic separation ineffective. The drying stage on a laboratory scale is conducted in drying pans under an exhaust hood. The drying and flashing on a larger (e.g., commercial scale) could be conducted in a shell heated rotary kiln designed for hydrocarbon use, such as an asphalt kiln. Petroleum off-gases may be recycled for fuel feed to the kiln.

Complete removal of all hydrocarbons from the heavy mineral grains was found not to be required for effective magnetic and electrostatic separation. Heating at 200° C. is found to create a non-sticky, free flowing sand with very little detectable remaining petroleum odor. Laboratory analysis shows the unheated feed contains non-detectable levels for $C_6$-$C_{12}$, 4590 ppm TPH for $C_{12}$-$C_{28}$, 4080 ppm TPH for $C_{28}$-$C_{35}$, with a total of 8720 ppm TPH. Caustic attritioned feed heated at 200° C. for 1 hour contains non-detectable levels for $C_6$-$C_{12}$, 251 ppm TPH for $C_{12}$-$C_{28}$, 246 ppm TPH for $C_{28}$-$C_{35}$, with a total of 497 ppm TPH. This is a 94% reduction in TPH. The boiling point of $C_{21}$ and above, which is primarily in the lubrication oil refined range, is generally above 200° C. Thermal cracking and oxidation of these higher range hydrocarbons contributes to the overall reduction of TPH.

A temperature of 100° C. was found not to be hot enough to effectively remove most of the hydrocarbons (only water was removed). Most of the initial TPH still remained after heating at 100° C. for up to 12 hours. This material still tends to adhere to electrostatic machinery surfaces and is not ideal for further dry processing.

Final high temperature calcining of heavy mineral products at 600-700° C. or greater, may be used to remove the last of the hydrocarbon—i.e., this step is conducted after the magnetic and electrostatic separations (described in more detail below) so that any alteration of to mineral processing properties is inconsequential. As discussed above, if the temperature range and sequence of high temperature treatment is not properly sequenced with respect magnetic and electrostatic separation operations, it can difficult or not possible to achieve effective magnetic and electrostatic separations.

Wet Mill Gravity Concentration of Sand Phase

After drying the sand fraction in the above step, the sand contains 30-50% heavy mineral by weight, including the desired titanium and zirconium minerals. This is upgraded to 80-90% by gravity concentration on a wet Wilfley™ shaker table or dry Oliver™ air table (on a laboratory scale), or in a wet spiral concentration circuit (large scale pilot and commercial operation) high grade spirals such as those available under the tradename MDMT™ HG10, along with finisher and scavenger spirals. Re-wetting of the dried sand is aided by the addition of a small amount of Calgon™ detergent (common household dish soap) to reduce the surface tension of the sand grains.

Oversized waste material may then be removed by screen at 60 mesh (250 μm). Approximately 13% by weight is greater than 60 mesh and contains alumino-silicates, coarse pyrite, coarse silica and other gangue minerals, along with several percent coarse zircon. Screening may be conducted either wet or dry, and on a commercial scale, hydroclones may be a more efficient classification technique. Classification improves performance of following gravity concentration steps, in addition to removing waste material. Coarse zircon and abrasive grade alumino-silicates can be recovered in a separate dry milling stream, if desired.

Magnetic and Electrostatic Separation of Heavy Minerals

The wet mill concentrate may dried and heated to approximately 120-150° C. to remove water for dry milling, as required for operation of electrostatic equipment. Drying can be conducted in either a rotary dryer or fluidized bed drier, which are both conventional in the art.

A high-tension roll separator is used to separate highly conductive pyrite from less conductive titanium minerals and non-conductive zircon. Multiple passes of conductive fraction at increasing voltage, generally starting at approximately 24 kV and decreasing in 2-3 kV increments, is used to pin less conductive minerals to roll starting with zircon and rutile, then leucoxene and ilmenite, while throwing the highly conductive pyrite from the roll. Roll rpm, maximum kV, the final number of passes are adjusted to achieve maximum removal of pyrite, which can vary with feed composition, grain size distribution, and environmental factors such as temperature and humidity.

Using high tension roll separations to remove waste pyrite from the heavy mineral stream eliminates undesirable $SO_2$ emissions produced from other methods that employ high temperature roasting to oxidize pyrite to iron oxides, which then are removed by magnetic separation. High tension roll separation of pyrite also has advantages over methods that use xanthanum gum floatation in the wet circuit to float out pyrite. Floatation reagents are expensive to use and dispose of properly, are not totally effective in pyrite removal, and also are miscible with the petroleum stream through recycled water system. This creates potential problems in the upstream bitumen recovery system.

The primary high-tension roll non-conductors, containing rutile and zircon, are sent to a multiple plate electrostatic plate separate, where any residual fine pyrite is removed to the conductor fraction. Approximately 24 kv potential is applied to the electrostatic plate separator. Next, the leucoxene, rutile and zircon bearing non-conductor fraction is separated on an induced roll magnet at approximately 5 amps. Less altered leucoxene is removed to the magnetic fraction, where it is then processed again on an electrostatic plate separator at approximately 24 kV, to remove any remaining silicates from the $TiO_2$ product. The rutile and zircon 5 amp non-magnetic fraction is then re-passed over an induced roll magnet at 10 amps. Rutile, highly altered leucoxene with a little zircon is removed to the 10 amp magnetic fraction. This is processed again over an electrostatic plate separator at approximately 24 kV to remove residual zircon as a non-conductor from the rutile and leucoxene $TiO_2$ product stream. The 10 amp non-magnetic fraction, containing zircon, minor amounts of rutile and highly altered leucoxene, is then processed again over an electrostatic plate separator at approximately 24 kV, to remove rutile and highly altered leucoxene from the zircon product stream. The non-magnetic, non-conductive zircon fraction is then passed over either a wet Wilfley™ table or a dry shaker table, to remove residual silica and kyanite contaminants, to produce a final zircon product.

The secondary, lower kV high tension roll non-conductors, containing leucoxene and some ilmenite, are passed over an electrostatic plate separator at approximately 18 kV to remove any residual fine pyrite as a conductor. It is then passed over an electrostatic plate separator at approximately 24 kV to remove residual non-conductive silicates. The conductive material is then fractionated on an induced roll magnet at 5, 7.5 and 10 amps, or as needed for $TiO_2$ product specifications, to produce ilmenite, less altered leucoxene, and highly altered leucoxene and rutile, respectively. If required the 10 amp non-magnetic fraction can then be processed again over an electrostatic plate separator at approximately 24 kV to remove any residual silicates from the high $TiO_2$ product.

While this invention has been described with reference to illustrative embodiments and examples, the description is not intended to be construed in a limiting sense. For example, is possible to modify the specific sequence of dry milling steps and/or the equipment used therein depending on factors such as flowsheet requirements and/or economics. For example, it is possible to utilize a wet-high intensity magnet ("Whims") in the wet stage to remove magnetic ilmenite earlier in the process. Further, it is possible to use equipment such as a Floatex™ separator to enhance gravity separation. Still further, it is possible to utilize hydrocyclones and other particle sizers to enhance particle classification in advance of gravity separation. Still further, it is possible to utilize other dry milling machines such as the CoronaStat™ to enhance dry mill separation in some applications. Thus, various modifications of the illustrative embodiments, as well as other embodiments of the invention, will be apparent to persons skilled in the art upon reference to this description. It is therefore contemplated that the appended claims will cover any such modifications or embodiments.

All publications, patents and patent applications referred to herein are incorporated by reference in their entirety to the same extent as if each individual publication, patent or patent application was specifically and individually indicated to be incorporated by reference in its entirety.

What is claimed is:

1. A process for recovering heavy minerals from tar sands, the tar sands including bitumen and heavy materials, the process comprising:

(i) contacting the tar sands with an aqueous liquid to form a bituminous froth comprising a solids fraction and a liquid fraction, the solids fraction comprising bitumen and heavy materials;

(ii) adding a hydrocarbon diluent to the bituminous froth to produce a diluted bituminous froth;

(iii) separating the solids fraction from the diluted bituminous froth to produce a treated solids fraction;

(iv) contacting the treated solids fraction with an aqueous liquid to cause production a bituminous phase and a heavy minerals phase; and (v) separating the heavy minerals phase from the bituminous phase by means of gravity separation to form a heavy minerals fraction having a substantial portion of bitumen removed therefrom (vi) subjecting the heavy minerals fraction to attritioning to remove additional bitumen from the heavy minerals fraction.

2. The process defined in claim 1, wherein (i) comprises contacting the tar sands with an aqueous liquid at a temperature in the range of from about 100° F. to about 200° F.

3. The process defined in claim 1, wherein (i) comprises contacting the tar sands with an aqueous liquid at a temperature in the range from about 110° F. to about 180° F.

4. The process defined in claim 1, wherein (i) comprises contacting the tar sands with an aqueous liquid at a temperature in the range of from about 120° F. to about 150° F.

5. The process defined in claim 1, wherein (iv) comprises contacting the treated solids fraction with an aqueous liquid at a temperature in the range of from about 100° F. to about 200° F.

6. The process defined in claim 1, wherein (iv) comprises contacting the treated solids fraction with an aqueous liquid at a temperature in the range of from about 110° F. to about 180° F.

7. The process defined in claim 1, wherein (iv) comprises contacting the treated solids fraction with an aqueous liquid at a temperature in the range of from about 120° F. to about 150° F.

8. The process defined in claim 1, wherein the hydrocarbon diluent is added in an amount sufficient to produce a stable emulsion of the diluted bituminous froth.

9. The process defined in claim 1, comprising:

(vi) subjecting the heavy minerals fraction to at lease one of, size fractionating, gravity separation and magnetic separation.

10. The process defined in claim 1, further comprising:

(vi) subjecting the heavy minerals fraction to successive stages of size fractioning, and magnetic separation.

11. A process for recovering heavy minerals from feedstock comprising tar sands, the tar sands including bitumen and heavy minerals, the process comprising:

(i) contacting the feedstock with water to form a bituminous froth comprising a solids fraction and a liquid fraction, the solids fraction comprising bitumen and heavy minerals;

(ii) separating the solids fraction from the liquid fraction;

(iii) contacting the solids fraction with water to cause production a bituminous phase and a heavy minerals phase; and (iv) separating the heavy minerals phase from the bituminous phase by means of gravity separation to form a heavy minerals fraction having at least about 78% of bitumen removed therefrom.

12. The process defined in claim 11, wherein (i) comprises contacting the feedstock with water at a temperature in the range of from about 100° F. to about 200° F.

13. The process defined in claim 11, wherein (i) comprises contacting the feedstock with water at a temperature in the range of from about 110° F. to about 180° F.

14. The process defined in claim 11, wherein (i) comprises contacting the feedstock with water at a temperature in the range of from about 120° F. to 150° F.

15. The process defined in claim 11, further comprising:

(v) subjecting the heavy minerals fraction to at least one of attritioning, size fractioning, gravity separation and magnetic separation.

16. The process defined in claim 11, further comprising:

(v) subjecting the heavy minerals fraction to successive stages of attritioning, size fractionating, and magnetic separation.

17. A process for recovering heavy minerals from tar sands-derived solids fraction comprising bitumen and heavy minerals, the process comprising:

(i) contacting the solids fraction with water to cause production a bituminous phase and a heavy minerals phase; and (ii) separating the heavy minerals phase from the bituminous phase by means of gravity separation to form a heavy minerals fraction having a substantial portion of bitumen removed therefrom.

18. The process defined in claim 17, wherein (i) comprises contacting the solids fraction with water at a temperature in the range of from about 100° F. to about 200° F.

19. The process defined in claim 17, wherein (i) comprises contacting the solids fraction with at a temperature in the range of from about 110° F. to about 180° F.

20. The process defined in claim 17, wherein (i) comprises contacting the solids fraction with water at a temperature in the range of from about 120° F. to about 150° F.

21. The process defined in claim 17, further comprising:

(iii) subjecting the heavy minerals fraction to at least one of attritioning, size fractionating, gravity separation and magnetic separation.

22. The process defined in claim 17, further comprising:

(iii) subjecting the heavy minerals fraction to successive stages of attritioning, size fractionating, and magnetic separation.

23. The process defined in claim 11, further comprising:

(v) subjecting the heavy minerals phase fraction to attritioning to remove additional bitumen from the heavy minerals fraction.

24. The process defined in claim 17, further comprising:

(iii) subjecting the heavy minerals fraction to attritioning to remove additional bitumen from the heavy minerals fraction.

* * * * *

UNITED STATES PATENT AND TRADEMARK OFFICE

CERTIFICATE OF CORRECTION

PATENT NO. : 7,341,658 B2
APPLICATION NO. : 10/417271
DATED : March 11, 2008
INVENTOR(S) : Robert G. Reeves It is certified that error appears in the above-identified patent and that said Letters Patent is hereby corrected as shown below:

Title page, item [73] should read as follows:
Assignee: Titanium Corporation Inc., Toronto (CA)

Signed and Sealed this

Fifth Day of May, 2009

JOHN DOLL
*Acting Director of the United States Patent and Trademark Office*